US006955637B1

(12) United States Patent
Montano et al.

(10) Patent No.: US 6,955,637 B1
(45) **Date of Patent: *Oct. 18, 2005**

(54) SEPARATION DEVICE HAVING A CENTRIFUGAL ROTOR

(75) Inventors: Jesus Montano, Tullinge (SE); Rolf Ridderstrale, Stockholm (SE); Klaus Hans Dieter Stroucken, Rönninge (SE)

(73) Assignee: Alfa Laval AB, Tumba (SE)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

This patent is subject to a terminal disclaimer.

(21) Appl. No.: 09/958,449

(22) PCT Filed: Mar. 21, 2000

(86) PCT No.: PCT/SE00/00552

§ 371 (c)(1),
(2), (4) Date: Jan. 29, 2002

(87) PCT Pub. No.: WO00/59640

PCT Pub. Date: Oct. 12, 2000

(30) Foreign Application Priority Data

Apr. 7, 1999 (SE) ..... 9901234

(51) Int. Cl.[7] ..... B04B 11/02
(52) U.S. Cl. ..... 494/41; 494/42; 494/62; 494/65
(58) Field of Search ..... 494/41–42, 46, 494/5–6, 38, 50, 60, 62, 65, 68–70, 901; 210/121–122, 210/360.1

(56) References Cited

U.S. PATENT DOCUMENTS

| | | | | |
|---|---|---|---|---|
| 791,496 | A * | 6/1905 | Ponten | 494/65 |
| 1,050,720 | A * | 1/1913 | Raasloff et al. | 494/6 |
| 1,056,233 | A * | 3/1913 | Trent | 494/42 |
| 1,712,184 | A | 5/1929 | Wendel | |
| 1,927,822 | A | 9/1933 | Coe | |
| 2,881,974 | A | 4/1959 | Ruf | |
| 2,928,592 | A * | 3/1960 | Johnson | 494/42 |
| 3,424,375 | A | 1/1969 | Maurer | |
| 3,756,505 | A * | 9/1973 | Miachon | 494/42 |

(Continued)

FOREIGN PATENT DOCUMENTS

EP 0164866 * 12/1985

(Continued)

*Primary Examiner*—Charles E. Cooley
(74) *Attorney, Agent, or Firm*—Michaud-Duffy Group LLP

(57) ABSTRACT

In a separation device for separating particles from a liquid, which is present in a container, a centrifugal rotor is rotatable around a vertical rotational axis. The centrifugal rotor has a tubular inlet member, which extends down into liquid to be treated and which upon rotation of the centrifugal rotor forms a pumping member adapted to pump liquid upwardly and into the centrifugal rotor. The rotatable inlet member is surrounded by a non-rotatable wall, a sealing device being adapted to seal between the rotatable inlet member and the non-rotatable wall. Thereby is avoided that liquid is pumped upwardly on the outside of the inlet member. Furthermore, a smallest possible part of the outside of the inlet member can be in contact with liquid, independent of the level of the liquid surface in the container.

15 Claims, 2 Drawing Sheets

U.S. PATENT DOCUMENTS

| | | | | | |
|---|---|---|---|---|---|
| 3,768,726 | A | * | 10/1973 | Hale et al. | 494/41 |
| 4,636,319 | A | * | 1/1987 | Stroucken | 210/781 |
| 4,753,632 | A | * | 6/1988 | Hofmann et al. | 494/42 |
| 5,364,335 | A | * | 11/1994 | Franzen et al. | 494/70 |
| 5,484,282 | A | * | 1/1996 | Trawoger et al. | 494/42 |
| 6,626,814 | B1 | * | 9/2003 | Setterberg | 494/41 |
| 6,802,804 | B1 | * | 10/2004 | Stroucken | 494/42 |

FOREIGN PATENT DOCUMENTS

| | | | | |
|---|---|---|---|---|
| EP | 0 047 677 | B1 | | 2/1986 |
| EP | 0 312 279 | B1 | | 4/1991 |
| EP | 0 312 233 | B1 | | 5/1992 |
| WO | WO 96/33021 | | | 10/1996 |
| WO | WO 96/33022 | | | 10/1996 |
| WO | 00/59639 | | * | 10/2000 |

* cited by examiner

SEPARATION DEVICE HAVING A CENTRIFUGAL ROTOR

FIELD OF THE INVENTION

The present invention relates to a centrifugal separation device for cleaning of a liquid from solid or liquid particles suspended therein and being lighter and/or heavier than the liquid, the separation device including a centrifugal rotor adapted to rotate around a vertical rotational axis, a driving device adapted for rotation of the centrifugal rotor around said rotational axis and a tubular inlet member which is connected with the centrifugal rotor and adapted to extend downwards from the centrifugal rotor and into a body of said liquid which is to be pumped by means of the inlet member into the centrifugal rotor.

BACKGROUND OF THE INVENTION

A separation device of this kind is known for instance through U.S. Pat. No. 1,927,822, U.S. Pat. No. 3,424,375 or EP 0 047 677 A2. The separation device can be applied directly onto a container containing the liquid to be cleaned.

Often it is not possible to keep the liquid surface in a container for liquid to be cleaned constantly at a predetermined level. Upon use of a separation device of the above said previously known kind the tubular inlet member, in a case like this, will be more or less immersed in the liquid. Since the inlet member has to extend under the liquid surface, when the liquid is at a relatively low level, this means that an undesired large part of the inlet member will be immersed in the liquid when the liquid surface is at a relatively high level.

One reason why the rotating inlet member should not be immersed deeper than necessary in the liquid to be cleaned is that this causes rotation of the liquid in the container. This reduces the pumping effect of the inlet member and causes undesired splitting of particles, which later are to be separated from the liquid in the centrifugal separator. Another reason is that an unreasonably high amount of energy is required to operate the centrifugal rotor.

SUMMARY OF THE INVENTION

This object can be achieved according to the invention by means of a non-rotatable wall, which is adapted to surround in said liquid body at least part of the rotatable inlet member and a sealing device adapted to seal between the non rotatable wall and the rotatable inlet member.

By the invention it is possible to minimise the surface of the rotatable inlet member being in contact with the liquid to be cleaned, irrespective of at which level the liquid surface is present. Thereby, rotation of the liquid present in the container and which is to be pumped upwardly through the inlet member is minimized. Furthermore, the invention avoids liquid being pumped upwardly on the outside of the inlet member as a consequence of the rotation of the liquid.

The sealing device may have any suitable construction. For instance, an annular lip gasket of rubber or some other elastic material may be supported by the nonrotatable wall and surround the inlet member and seal radially against the outside thereof. Alternatively, a similar annular lip gasket may be carried by the rotatable inlet member, so that by means of centrifugal force it can be kept pressed radially outwardly against the surrounding non-rotatable wall.

In a preferred embodiment of the invention the sealing device includes an annular axially movable sealing member and means adapted to accomplish an axial sealing force between the non-rotatable wall or non-rotatable members connected therewith and the rotatable inlet member. The sealing member may be rotatable together with the inlet member, but preferably it is non-rotatable and adapted to be pressed axially against a sealing surface, preferably an end surface of the rotatable inlet member.

To achieve the best possible preconditions, as to function, for the sealing device when the centrifugal rotor is suspended from a flexible suspension device, the non-rotatable wall is suspended from the same flexible suspension device as the centrifugal rotor. In this way relative pendulum movements between the rotatable inlet member and the non-rotatable wall are avoided during operation of the centrifugal rotor.

BRIEF DESCRIPTION OF THE DRAWINGS

The invention is described in the following with reference to the accompanying drawing, in which.

DETAILED DESCRIPTION OF THE PREFERRED EMBODIMENT

Figure 1:
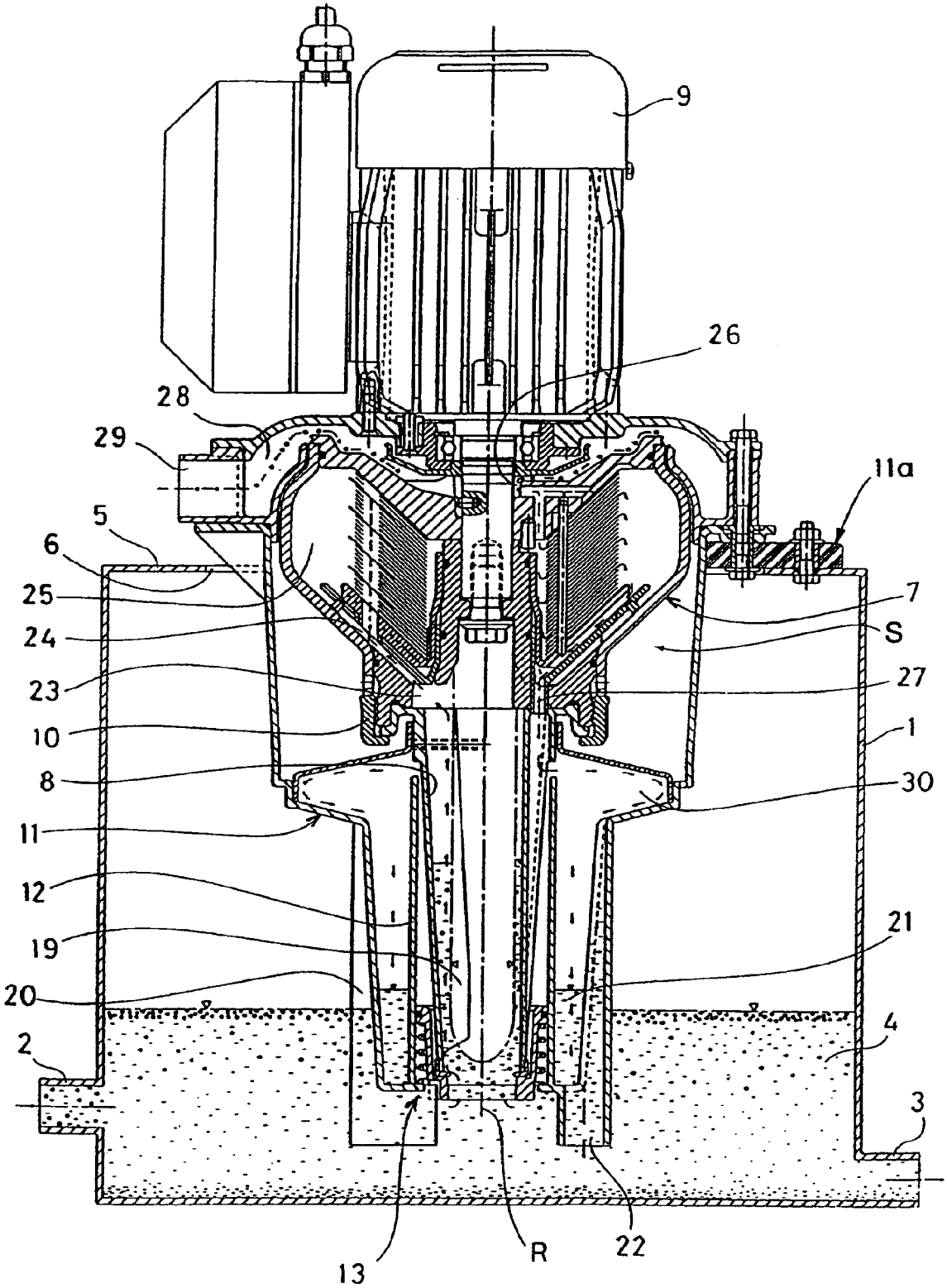
FIG. 1 shows a separation device according to the invention and a container containing liquid to be cleaned by means of the separation device.

FIG. 1 shows a container 1 having an inlet 2 for liquid to be cleaned and an outlet 3 for liquid having been cleaned from particles suspended therein. In the container 1 there is a liquid body 4, in which some relatively light particles have accumulated in a surface layer and some relatively heavy particles have accumulated in a bottom layer.

The container 1 has an upper wall 5 having an opening 6. On the wall 5 there is mounted a centrifugal separation device according to the invention and indicated generally by the letter S, which extends down into the container. The separation device S includes a centrifugal rotor 7, an inlet member 8 connected with the centrifugal rotor and a motor 9 for rotation of the centrifugal rotor 7 and the inlet member 8 around a vertical rotational axis R.

The inlet member 8, which is tubular and slightly conical, is connected with the centrifugal rotor by means of a lock ring 10 and extends downwards into the container 1, so that it is immersed in the liquid body 4. Both the centrifugal rotor 7 and the inlet member 8 are surrounded by a stationary casing 11, which also extends downward into the container 1, so that it is immersed in the liquid body 4 around the inlet member 8.

The whole separation device S, including the casing 11, is suspended flexibly in a suspension device 11*a* on the upper side of the container wall 5. Thus, if the centrifugal rotor 7 and its inlet member 8 vibrate or undergo small pendulum movements during operation, the casing 11 will move in the same way.

Closest to the inlet member 8 the casing 11 forms a cylindrical surrounding wall 12, which extends from the liquid free part of the container 1 down into the liquid body 4. At its lower part the surrounding wall 12 carries a sealing device 13 adapted to accomplish sealing between the stationary surrounding wall 12 and the rotatable inlet member 8.

Figure 2:
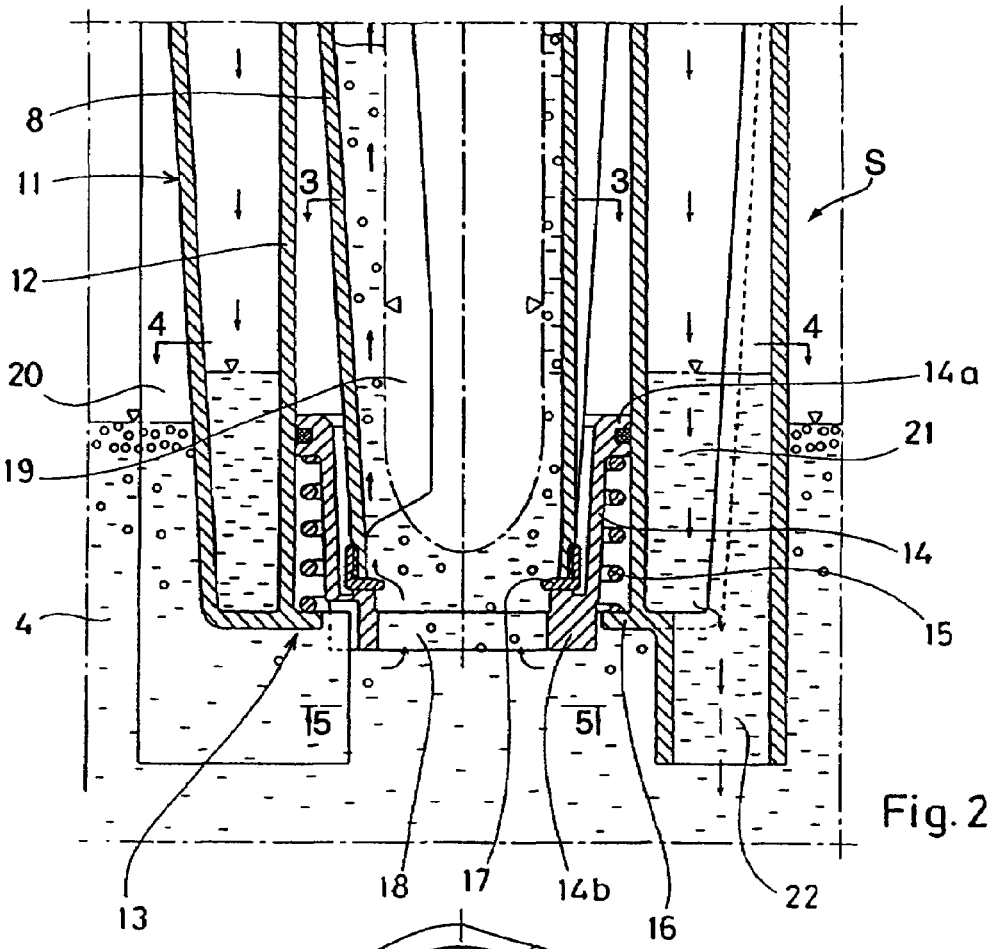
FIG. 2 shows part of the separation device in FIG. 1 on an enlarged scale.

As best seen in FIG. 2, the sealing device 13 includes an axially movable sleeve formed sealing member 14. Through an upper part 14*a* the sealing member 14 abuts sealingly around its circumference against the inside of the surrounding cylindrical wall 12. By means of a coil spring 15, which rests on an annular flange 16 connected with the surrounding wall 12, the sealing member 14 is pressed axially upwardly with reference to FIG. 2. Thereby, a lower part 14*b* of the sealing member 14 is kept pressed axially against another sealing member 17, which is connected with the lowermost part of the rotatable inlet member 8. The sealing members 14 and 17 thus abut against each other through respective axially directed sealing surfaces.

Figure 5:
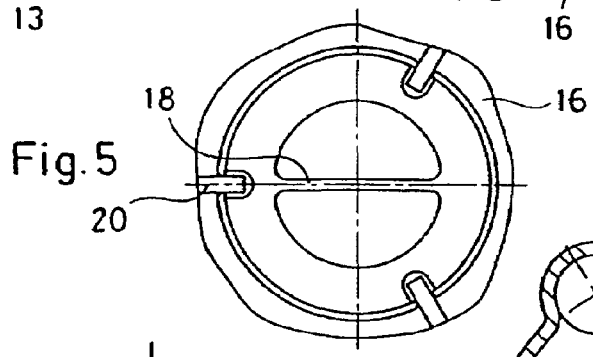
FIG. 5 is a sectional view taken along line 5—5 in FIG. 2.

Said lower part 14*b* of the sealing member 14 has a central through opening, which is bridged by a wing 18 intended to impede rotation of liquid present in the container 1 below the separation device. The extension of the wing 18 is also shown in FIG. 5.

Figure 3:
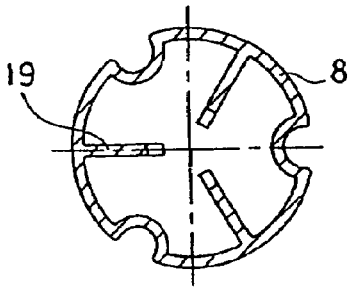
FIG. 3 is a sectional view taken along line 3—3 in FIG. 2.

FIG. 3 shows a section through the inlet member 8 along a line 3—3 in FIG. 2. As can be seen, the inlet member has three internal wings 19, which extend both radially and axially through the whole of the inlet member 8 up to the centrifugal rotor 7 (see FIG. 1). The wings 19 are adapted to entrain liquid in the rotation of the inlet member during operation of the separation device.

Figure 4:
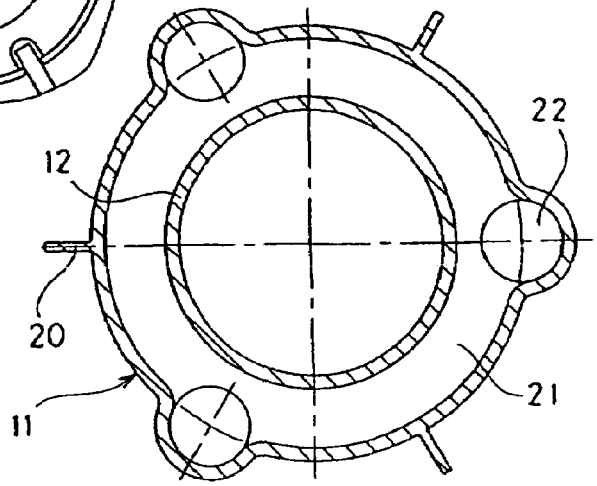
FIG. 4 is a sectional view taken along line 4—4 in FIG. 2.

FIG. 4 shows a section through the casing 11 along the line 4—4 in FIG. 2. On its outside the casing has wings 20, which extend both radially and axially and which have for its purpose to counteract rotation of liquid in the container 1. As can be seen from FIGS. 1 and 2, there is delimited in the casing 11*a* space 21, which through three channels 22 communicates with the interior of the container 1 below the separation device.

The centrifugal rotor 7 is not described in detail in the following, since it can be substituted with any suitable centrifugal rotor of a known kind having a different construction. For a description in detail of a suitable centrifugal rotor reference is made to for instance EP 312 233 B1, EP 312 279 B1, WO 96/33021 and WO 96/33022.

In the area of the connection between the inlet member 8 and the centrifugal rotor 7 there is delimited in the latter an inlet chamber 23. Via an inlet channel 24 the inlet chamber 23 communicates with a separation chamber 25. The centrifugal rotor 7 has an outlet 26 for a separated relatively light liquid and an outlet 27 for a separated relatively heavy liquid.

The surrounding casing 11 has a receiving chamber 28 and an outlet 29 therefrom for separated light liquid leaving the centrifugal rotor. Furthermore, the casing 11 has a receiving chamber 30 for separated heavy liquid leaving the centrifugal rotor. The receiving chamber 30 communicates with the aforementioned space 21 in the casing 11.

The above described separation device operates in the following manner upon cleaning of a liquid containing both liquid particles lighter than the liquid and solid particles heavier than the liquid.

When the motor 9 is started for driving the centrifugal rotor 7 and the inlet member 8 connected therewith around the rotational axis R, the inlet member 8 will operate as a pumping member, by means of which the liquid is pumped from the liquid body 4 into the centrifugal rotor. Within the inlet member 8 a substantially cylindrical liquid surface will be formed, as illustrated in the FIGS. 1 and 2, which extends all the way from the lower part of the inlet member to the inlet chamber 23 of the centrifugal rotor. In the liquid body thus formed in the inlet member 8 and being entrained in the rotation thereof by the wings 19 (see FIG. 3) liquid will flow axially upwardly, as illustrated by means of arrows in the FIGS. 1 and 2. Centrally in the inlet member 8 there is left an air filled space, which if desired may communicate with air surrounding the inlet member 8. For this purpose the inlet member 8 may carry a thin tube extending from the center of the inlet member radially outwardly to the outside of the inlet member. A pipe of this kind is indicated by dotted lines in FIG. 1 at the upper part of the inlet member 8.

Liquid entering the inlet chamber 23 of the centrifugal rotor 7 through the inlet member 8 is conducted therefrom through the inlet channel 24 into the separation chamber 25. In this there is arranged a set of conical separation discs, which between themselves form thin separation spaces. In the separation spaces those particles of different kinds, which are suspended in the liquid, are separated due to the light liquid particles being forced by the centrifugal force to move towards the rotational axis of the centrifugal rotor and, after having coalesced to a continuous phase, further out through the outlet 26, while the heavy solid particles are forced to move towards the radially outermost part of the separation chamber 25, where they deposit on the surrounding wall of the centrifugal rotor. The cleaned liquid first flows in a direction from the rotational axis of the centrifugal rotor out of said separation spaces and after that through one or more collection channels again towards to rotational axis to the centrifugal rotor outlet 27 for separated relatively heavy liquid.

Whereas separated relatively light liquid is conducted through the outlet 29 in the casing 11 to a particular recipient, the cleaned liquid is conducted from the outlet 27 back to the liquid body 4 in the container 1. Thus, the cleaned liquid is conducted through the receiving chamber 30 to the space 21 in the casing 11 and from there through the channel 22 out into the liquid body 4.

If the amount of light liquid separated from the heavier liquid is small, there is returned to the liquid body 4 a flow of liquid that is substantially of the same magnitude as that which is pumped therefrom into the centrifugal rotor 7. A certain difference as to level will come up between the liquid surfaces in the space 21 and the surrounding container 1, respectively, as illustrated in the FIGS. 1 and 2.

The stationary wall 12, which surrounds the inlet member 8 and supports a part of the sealing device 13, need not necessarily be carried by the casing 11. The wall 12 alternatively may be carried by the container 1. However, the arrangement shown in the drawing is advantageous for the function of the sealing device 13. Thus, it is an advantage that both of the co-operating sealing members 14 and 17 are carried by one and the same suspension device. Since a suspension device for the rotatable centrifugal rotor 7 should be flexible, and the rotatable part of the sealing device 13 thereby becomes flexibly suspended, also the non rotatable part of the sealing device should, thus, be flexibly suspended.

As indicated above a separation device according to the invention may be used for cleaning of a liquid independent of whether the liquid is to be cleaned from particles heavier than the liquid or particles lighter than the liquid. Of course, the construction of the centrifugal rotor then has to be adapted to the separation duty in question. It is also possible that the particles—solid or liquid—to be separated from a liquid are more valuable than the liquid itself and that, thus, the separating operation could not really be named a liquid cleaning operation. Furthermore, it is not a prerequisite for the invention that the liquid having been freed from particles should be returned to the container 1.

What is claimed is:

1. A separation device comprising:

a centrifugal rotor suspended from a flexible suspension device and adapted to rotate around a vertical rotational axis, a driving device adapted for rotation of the centrifugal rotor around said rotational axis, a tubular inlet member, which is connected with the centrifugal rotor and adapted to extend downwards from the centrifugal rotor and into a body of liquid, which is to be pumped by means of the inlet member into the centrifugal rotor, a non-rotatable wall which is adapted to surround in said body of liquid at least part of the rotatable inlet member, the non-rotatable wall being suspended from the flexible suspension device for avoiding relative pendulum movements between the rotatable inlet member and the non-rotatable wall during operation of the centrifugal rotor, and a sealing device adapted to seal between the non-rotatable wall and the rotatable inlet member.

2. A separation device according to claim 1, wherein the sealing device includes an annular axially movable sealing member and means adapted to accomplish an axial sealing force between the non-rotatable wall and the rotatable inlet member.

3. A separation device according to claim 2, in which the annular sealing member is non-rotatable and adapted to be pressed axially against a sealing surface on the rotatable inlet member.

4. A separation device according to claim 3, in which an end surface of the rotatable inlet member forms said sealing surface.

5. A separation device according to claim 4, in which the sealing surface is a generally radial surface.

6. A separation device according to claim 2 wherein the means adapted to accomplish a sealing force comprises a spring.

7. A separation device according to claim 6 wherein the spring is a coil spring.

8. A separation device according to claim 6 wherein the non-rotatable wall has a flange and the spring acts between the flange and the sealing member.

9. A separation device according to claim 8 wherein the non-rotatable wall comprises a cylindrical wall coaxially surrounding the inlet member and the flange comprises an annular flange.

10. A separation device comprising:

a centrifugal rotor adapted to rotate around a vertical rotational axis, a driving device adapted for rotation of the centrifugal rotor around said rotational axis, a tubular inlet member, which is connected with the centrifugal rotor and adapted to extend downwards from the centrifugal rotor and into a body of liquid, which is to be pumped by means of the inlet member into the centrifugal rotor, a non-rotatable wall, which is adapted to surround in said body of liquid at least part of the rotatable inlet member, and a sealing device adapted to seal between the non-rotatable wall and the rotatable inlet member and including an annular axially movable sealing member and means adapted to accomplish an axial sealing force between the non-rotatable wall and the rotatable inlet member;

said annular sealing member being non-rotatable and adapted to be pressed axially against a sealing surface on the rotatable inlet member and wherein an end surface of the rotatable inlet member forms the sealing surface.

11. A separation device according to claim 10, in which the sealing surface is a generally radial surface.

12. A separation device according to claim 10 wherein the means adapted to accomplish a sealing force comprises a spring.

13. A separation device according to claim 12 wherein the spring is a coil spring.

14. A separation device according to claim 12 wherein the non-rotatable wall has a flange and the spring acts between the flange and the sealing member.

15. A separation device according to claim 14 wherein the non-rotatable wall comprises a cylindrical wall coaxially surrounding the inlet member and the flange comprises an annular flange.

* * * * *